United States Patent [19]

Tattershall

[11] 4,138,175

[45] Feb. 6, 1979

[54] FREEZER ORGANIZER

[76] Inventor: Donald R. Tattershall, P.O. Box 7546, Tulsa, Okla. 74105

[21] Appl. No.: 716,977

[22] Filed: Aug. 23, 1976

[51] Int. Cl.[2] ..... A47B 51/00

[52] U.S. Cl. ..... 312/270; 312/340; 312/341 R; 211/187

[58] Field of Search ..... 312/334, 339, 340, 338, 312/191, 203, 350, 270, 355, 271, 242; 211/86, 187

[56] References Cited

U.S. PATENT DOCUMENTS

| | | | |
|---|---|---|---|
| 1,861,123 | 5/1932 | Kuckel | 312/340 |
| 2,644,588 | 7/1953 | Brown | 312/339 |
| 2,649,351 | 8/1953 | Rothchild | 312/339 |
| 2,719,772 | 10/1955 | Perkwitz | 312/340 |
| 2,724,630 | 11/1955 | Saunders | 312/340 |
| 2,729,314 | 1/1956 | Doran | 211/187 X |
| 3,018,898 | 1/1962 | Frazelle | 211/86 |
| 3,058,595 | 10/1962 | Jones | 211/86 |
| 3,185,535 | 5/1965 | Williams | 312/242 |
| 3,612,633 | 10/1971 | Bloom | 312/270 |

FOREIGN PATENT DOCUMENTS

| | | | |
|---|---|---|---|
| 157211 | 1/1904 | Fed. Rep. of Germany | 312/340 |
| 851660 | 1/1940 | France | 312/329 |

*Primary Examiner*—Victor N. Sakran

*Attorney, Agent, or Firm*—Head, Johnson & Chafin

[57] ABSTRACT

Space saving and organizing means particularly designed and constructed for use with refrigerators, freezers, freezer compartments, and the like, and comprising support means having a plurality of horizontally extending slide rods adjustably secured thereto and movable between a contracted and extended position with respect to the support means, shelf means removably supported by said slide rods and slidable independently with respect thereto in one horizontal movement for providing access to a portion of the shelf and movable simultaneously therewith in a second horizontal movement to a cantilever position for providing ready access to the entire upper surface of the shelf to facilitate access to all of the contents disposed on the shelf means.

5 Claims, 10 Drawing Figures

FREEZER ORGANIZER

BACKGROUND OF THE INVENTION

1. Field of the Invention

This invention relates to improvements in shelving apparatus and more particularly, but not by way of limitation, to shelving structure for utilizing and organizing the space in a refrigerator, freezer, freezer compartment, or the like.

2. Description of the Prior Art

Home freezers and refrigerators having freezing compartments are in widespread use today for storing foods over relatively great periods of time. The home freezers are relatively large appliances, and many persons do not have a sufficiently large living area to house a freezer. The freezing compartments in most refrigerators are relatively small and are usually completely empty compartments; that is, they do not contain shelves or the like, but are merely open storage compartments for storing relatively limited supplies of frozen foods. As a result, the foods are normally piled in the compartment in a rather helter-skelter manner, with packages arranged on top of one another, making access to most of the food difficult, in addition to which it is substantially impossible to ascertain just what foods are stored or contained in the compartment.

SUMMARY OF THE INVENTION

The present invention contemplates a device which may be either permanently installed in a freezer compartment, or the like, as original equipment by the manufacturer thereof, or may be a completely separate unit purchased subsequent to the manufacture of a refrigerator, or the like, for use in the freezer compartment thereof. The device comprises a first upright support means spaced from a second upright means for supporting a plurality of vertically spaced shelves therebetween. Slide rod means is adjustably secured to each of the upright support means for removably receiving the opposite ends of the shelves thereon. The slide rods cooperate with the shelves in such a manner that a first forwardly horizontal movement of a shelf will position the shelf forwardly with respect to the outer confines of the freezer compartment for easy access to most of the materials disposed on the shelf. A continued forwardly horizontal movement of the shelf will cause a simultaneous forwardly movement of the slide rod whereby the entire shelf will be in a cantilevered position disposed forwardly of the adjacent shelves in order to provide ready access to every item disposed on the shelf. The vertical spacing between adjacent shelves may be adjusted as desired, with each shelf being independently supported for selective access to the entire upper surface thereof, not only for ascertaining the identification of the contents disposed thereon, but also for easily retrieving any items therefrom or storing any items thereon, as desired.

The flexibility of the use of the portable modification of the device of the invention permits transient persons to purchase the unit for temporary installation in substantially any freezer compartment, or the like, or rented establishments, since the device may be readily assembled, installed, and subsequently removed for future reuse without damage to the compartments. Thus, persons of mobile-type life style may enjoy opportunities and advantages of freezers and the like heretofore available only in a more permanent residence or living situation. In addition, the space saving and organizing aspects of the invention permits many families who could not heretofore do so take advantage of price economies available in volume food purchasing, since even small freezing areas may be utilized for storing relatively great quantities of foods. Furthermore, both the portable and permanent modifications of the invention result in a savings of energy used for freezing goods since studies have shown that the space saving and organized arrangement and storage of foods as possible with the novel device make a more efficient use of the cooling energy in a freezing compartment.

The novel space saver and organizer device is simple and efficient in operation and economical and durable in construction.

DESCRIPTION OF THE PREFERRED EMBODIMENTS

Figure 2:
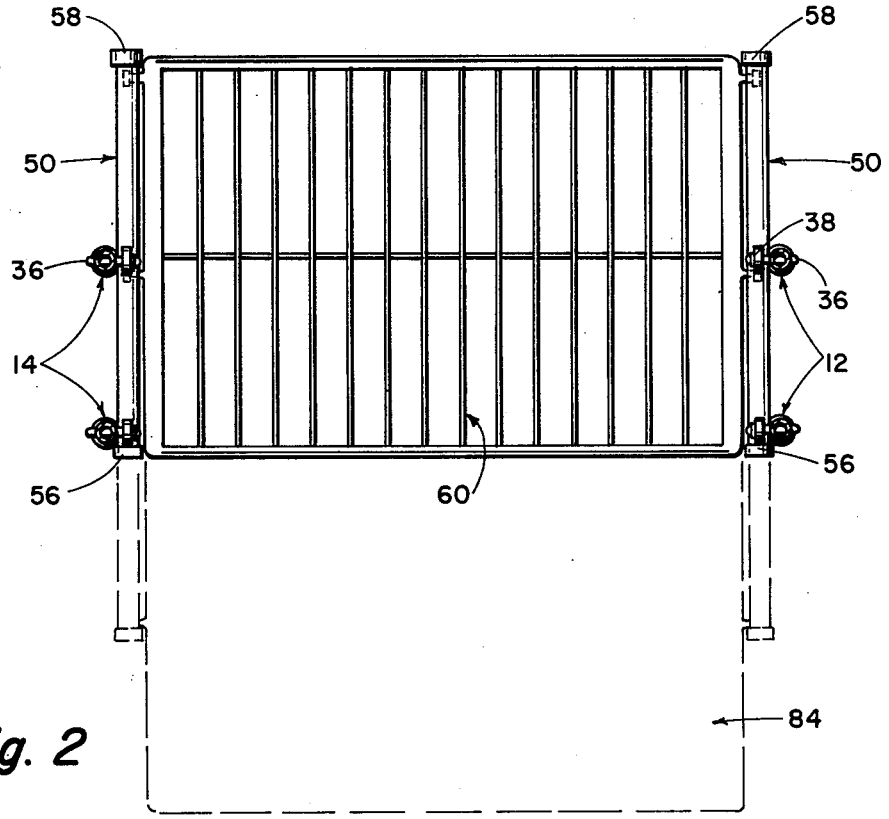
FIG. 2 is a view taken on line 2—2 of FIG. 1.

Referring to the drawings in detail and particularly FIGS. 1 through 7, reference character 10 generally indicates a space saver and organizer device comprising a first pair of spaced upright side support members 12 and a second pair of substantially identical spaced side support members 14 disposed in substantial alignment therewith as particularly shown in FIG. 2. Each support member 12 and 14 as shown herein preferably comprises an outer sleeve 16 having one end thereof closed by a foot member 18 and the opposite end thereof open for slidably receiving an inner rod 20 therein. The rod 20 is provided with a central bore 22 (FIG. 6) extending longitudinally therein for receiving a suitable helical spring 24 therein as particularly shown in FIG. 6. The outer end of the rod 20 is closed as shown at 26 in FIG. 6 and is preferably provided with an end cap member 28. A suitable stop member 30, such as a screw or the like is spaced below the open end of the sleeve 16 and extends through the sidewall of the sleeve 16 and into the central bore thereof whereby one end of the spring 24 may be anchored on the stop 30, and the opposite end of the spring 24 may be anchored against the closed upper end 26 of the rod 20 in order that the spring 24 will constantly urge the rod 20 axially outwardly with respect to the sleeve 16, for a purpose as will be hereinafter set forth.

Figure 1:
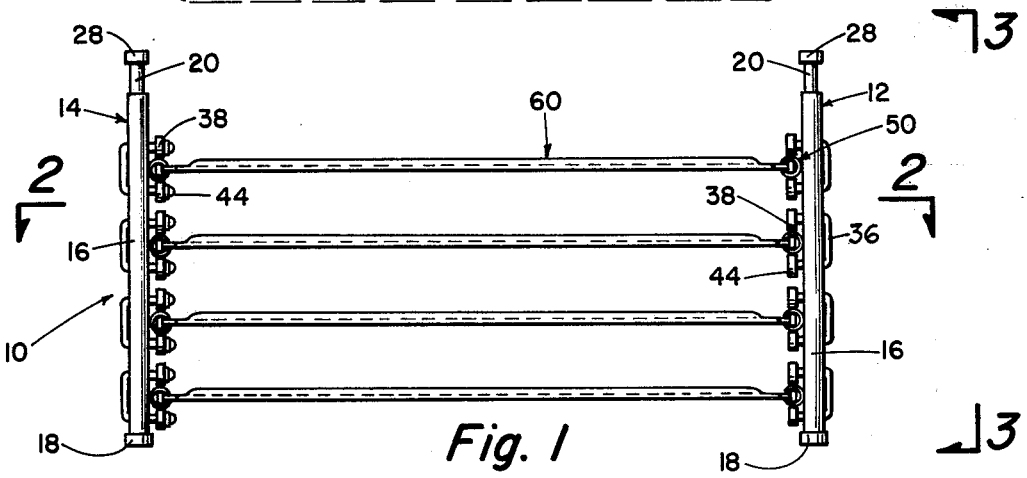
FIG. 1 is a front elevational view of a space saving and organizing device embodying the invention.
Figure 3:
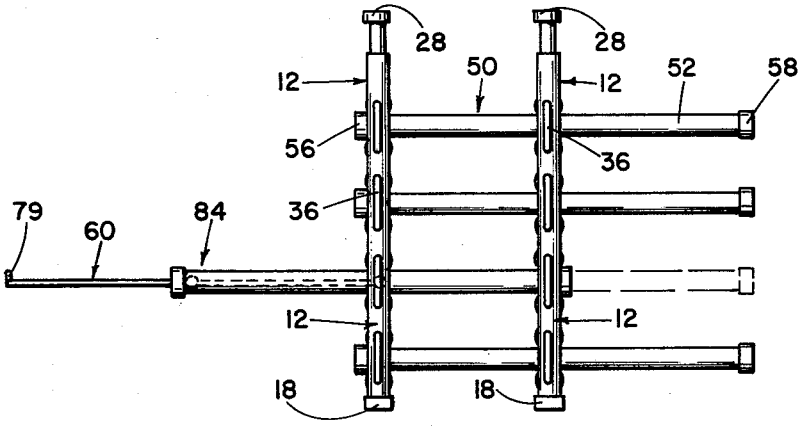
FIG. 3 is a view taken on line 3—3 of FIG. 1.

A plurality of longitudinally spaced bores 32 (FIG. 5) are provided in the sidewall of each sleeve 16 in substantial axial alignment with a plurality of similarly spaced diametrically opposed bores 34. Complementary pairs of the bores 32-34 removably receive the free ends of a substantially U-shaped bracket member 36 therethrough. The free ends of the bracket 36 preferably extend inwardly as shown in FIG. 1. A first roller member 38 is suitably journalled on one free end of the bracket 36 and spaced from the sleeve 16 by a spacer 40, and retained in position by a suitable nut member 42 threadedly secured to the respective free end of the bracket 36. A second roller member 44 is suitably journalled on the other free end of the bracket 36 in substantial planar alignment with the first roller 38 and spaced from the sleeve 16 by a spacer 46. The roller 44 is retained in position by a suitable nut 48 threadedly engaged with the respective free end of the bracket 36. The outer peripheries of the rollers 38 and 44 are spaced apart from receiving a slide rod assembly 50 therebetween.

Whereas the slide rod assemblies 50 may be of any suitable type, as shown herein each assembly 50 comprises an elongated substantially cylindrical tube 52 having a extending longitudinally slot 54 in the sidewall thereof to provide access to the interior of the tube. The opposite ends of the tube 54 are closed by an enlarged head member 56 and 58, respectively, as particularly shown in FIGS. 2 and 3. The tube 52 is disposed between the spaced corresponding wheels or rollers 38 and 44 in such a manner that the outer periphery of the tube 52 is slidable with respect to the outer periphery of the rollers. It is preferable that the outer periphery of each roller 38 and 44 be of a concave configuration complementary to the arcuate configuration of the outer periphery of the tube 52, as clearly shown in FIG. 5 for facilitating retaining of the tube 52 in position therebetween. However, it will be apparent that the outer periphery of the rollers 38 and 44 is not limited to a concave configuration, although it is preferable that the overall configuration of the rollers 38 and 44 and the tube 52 be complementary in order to facilitate the sliding movement of the tube as will be hereinafter set forth.

The corresponding pairs of rollers 38 and 44 of the support rods 12 are preferably disposed in substantial horizontal alignment with a similar corresponding pair of rollers 38 and 44 of the support rod 14, as shown in FIG. 1, whereby a slide rod assembly 50 may be carried by the aligned pair of rollers for receiving a suitable shelf assembly 60 therebetween. Each shelf structure 60 is slidably secured to the respective slide rod assemblies 50; and as shown herein, the opposite side edges of each shelf structure 60 is provided with a plurality, preferably two, of outwardly extending arms 61 having a roller member 62 suitably journalled on the outer end thereof. The arm 61 is preferably threadedly secured to the side edge of the shelf structure 60 in order that the position of the roller member 62 with respect to the shelf may be adjusted as desired or required. The roller member 62 is disposed within the tube 52, preferably prior to attachment of the stop members 56 and 58 on the tube, and the arm members 62 extend radially outwardly through the slot 54, as clearly shown in FIG. 6. It will be readily apparent that the rollers 62 may move freely along the length of the interior of the tube 52 until the rollers engage either the stop member 56 or the stop member 58, for a purpose as will be hereinafter set forth.

Figure 8:
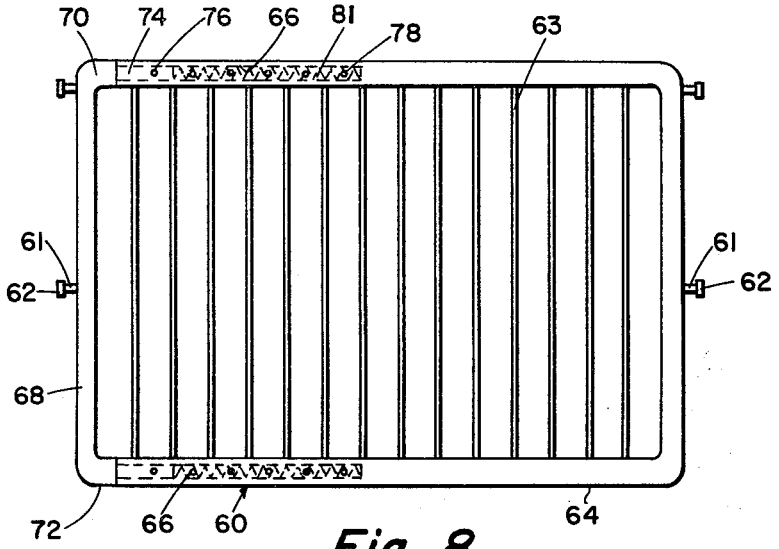
FIG. 8 is a plan view of an adjustable shelf such as may be utilized in the invention.

Referring now more particularly to FIG. 8, the shelf structure 60 as shown therein is of an adjustable length and comprises an outer frame 64 of a substantially U-shaped configuration, having a central grid-type portion 63 of any desired construction. The central portion may be of a solid-type construction if desired. A longitudinally extending bore 66 is provided in each of the free ends of the frame 64. A complementary frame element 68 of a length generally corresponding to the width of the frame 64 and having oppositely disposed perpendicularly extending legs 70 and 72 is adjustably secured to the free ends of the frame 64. Each leg 70 and 72 is provided with an axially extending stud member 74 adapted to be slidably inserted within the respective bore 66. Each stud 74 is provided with a bore 76 extending diametrically therethrough for selective axial alignment with one of a plurality of spaced apertures 78 provided in the frame 64. The apertures 78 are in communication with the bores 66, and a suitable helical spring 81 is disposed within each bore 66 with one end of the spring 81 being anchored at the closed end of the bore 66 and the opposite end of the spring 81 being anchored at the stud 74. The studs 74 may be inserted into the bores 66 against the force of the spring 81 until the bore 76 is in alignment with a preselected aperture 78, and a suitable pin member (not shown) may be inserted through the aligned bore and aperture for securely retaining the studs in the bores 66.

In the event the overall length of the shelf 60 is too long for the space wherein the shelf is to be used, the free ends of the J-shaped frame 64 may be cut a sufficient amount for shortening the length of the shelf, and the studs 74 may be replaced in the respective bores 66, with the bores 76 aligned with the proper aperture 78 and secured to the frame 64, thus providing substantially any desired overall length for the shelf 60. In addition, it is preferable to provide an upwardly extending flange 79 (FIG. 3) along the forward edge of the sheld 60 and a similar flange (not shown) along the back edge for precluding accidental loss of the contents of the shelf when the shelf is moved, as will be hereinafter set forth.

Figure 4:
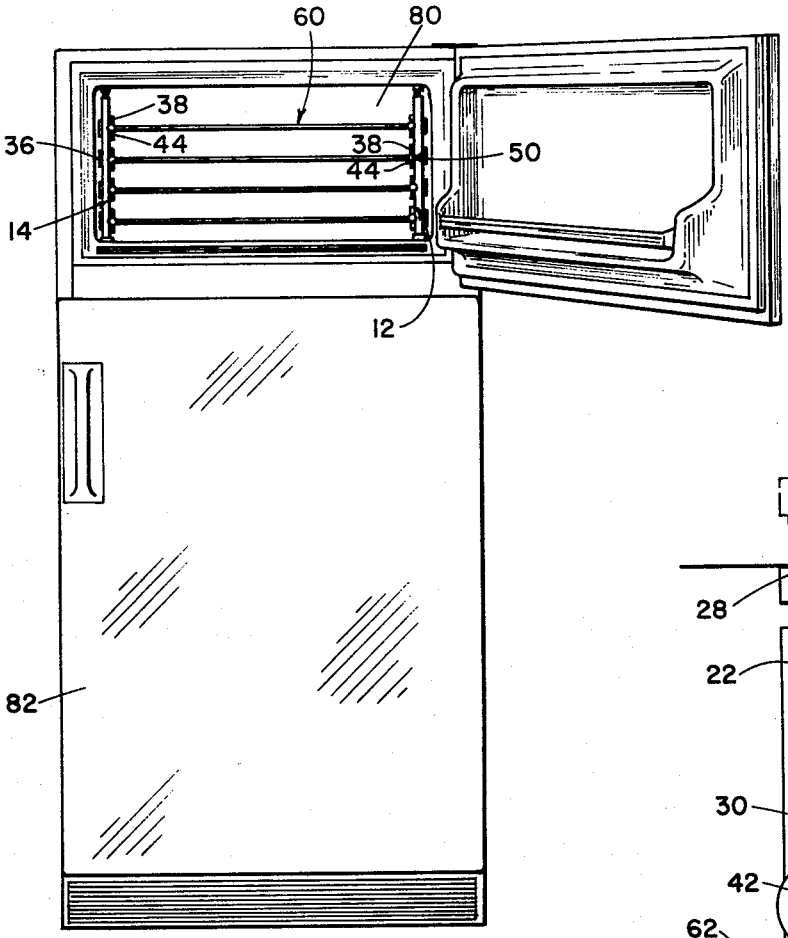
FIG. 4 is a front perspective view of a refrigerator having a top freezer compartment provided with a space saving and organizing device of the type shown in FIGS. 1, 2, and 3.
Figure 6:
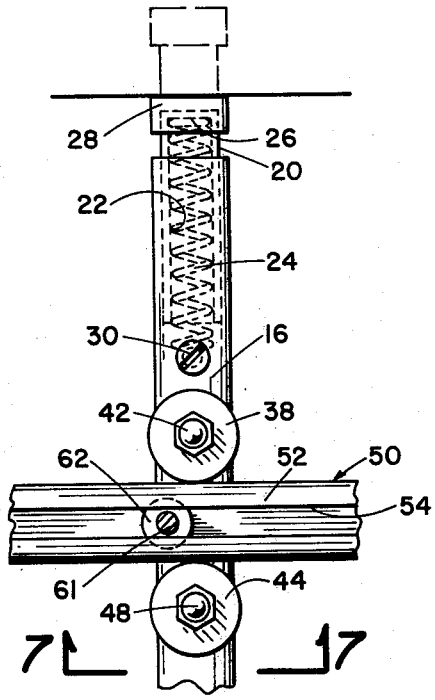
FIG. 6 is a view taken on line 6—6 of FIG. 5.
Figure 5:
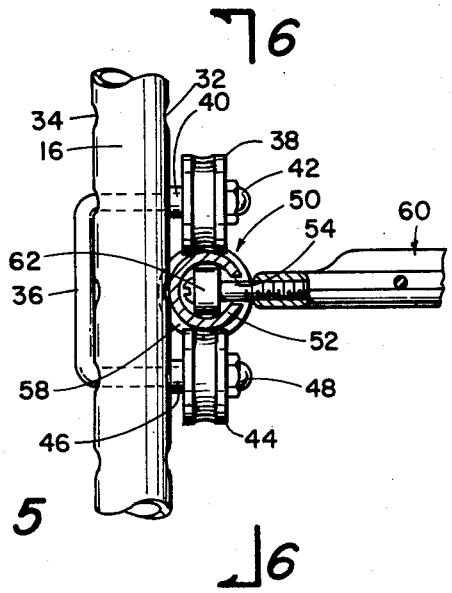
FIG. 5 is an enlarged detail view of a portion of a slide rod member as used in the invention.
Figure 7:
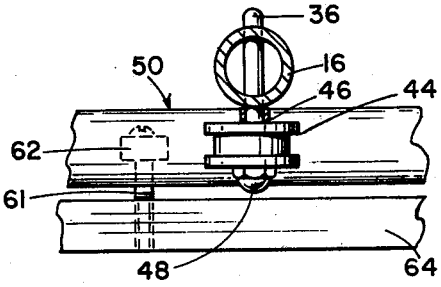
FIG. 7 is a view taken on line 7—7 of FIG. 5, with one portion in a slightly moved position for purposes of illustration.

In use, the space saver and organizer unit 10 may be readily installed in the usual empty freezer compartment 80 of a normal refrigerator 82 as particularly shown in FIG. 4. The support rods 12 and 14, having the reciprocal slide rod assemblies 50 secured thereto at the desired or preselected position and spacing thereon may be disposed within the compartment 80 with the foot members 18 being disposed on the bottom of the compartment 80, and the head members 28 being in engagement with the top of the compartment 80. The spring members 24 constantly urge the head member 28 in an upward direction, as viewed in FIGS. 1, 3, and 4, whereby the support rods 12 and 14 will be securely retained in position in the compartment 80. As will be seen in FIG. 3, the rods 12 are spaced apart in such a manner that in the normal position for the slide rod assemblies 50 carried, the stop members 56 will be disposed adjacent the outer periphery of the leading rod 12, and the stop members 58 will be spaced rearwardly therefrom. In fact, it is preferable that one of the support rods 12 be disposed in the proximity of the leading end of the slide rod assemblies 50, and the second support rod 12 be disposed substantially in the center of the slide rod assemblies 50 in the normal position of the slide rods when the device 10 is disposed within the compartment 80.

Furthermore, in the normal storage use position of the device 10 within the compartment 80, the shelves 60 are preferably disposed in the rearward-most position therefor as shown in solid lines in FIG. 2, whereby the entire unit 10 is contained within the confines of the compartment 80. In this position, a plurality of shelves 60 are disposed within the compartment to divide the normally empty compartment into a plurality of smaller storage areas for increasing the available use area of the compartment 80. Food products, or the like (not shown) may be stored on each shelf 60 in an efficient and organized manner, whereby substantially the entire volume of the compartment 80 is available for the storage of goods.

When it is desired to retrieve any of the items or goods disposed on one of the shelves 60, the leading or forward edge of the shelf 60 may be manually grasped and the shelf and slide rods may be pulled forwardly from the confines of the compartment 80 through a relatively short distance, as for example, until the stops 58 engage the respective supports 12. In this position, substantially half of the shelf 60 may be positioned substantially cantilevered or in a first extended position from the remaining portion of the device 10 and forwardly of the leading limit of the compartment 80. Most of the contents disposed on the shelf 60 so positioned will be accessible for removal from the shelf or for inspection or any other desired purpose. If additional access to the contents of the shelf is required, the shelf 60 may be manually pulled forwardly through a greater distance, whereby the forwardly disposed roller members 62 roll within the respective tubes 52 until the rollers engage the stop member 56. The shelf will then be in the forward position thereof shown at 84 in FIGS. 2 and 3. In this position, substantially the entire width of the shelf 60 is cantilevered beyond the remaining portions of the device 10 and beyond the forward confines of the compartment 80.

Alternatively, the leading or forward edge of the shelf 60 may be grasped, and the shelf may be pulled forwardly from the confines of the compartment 80 until the roller 62 engages the stop 56 to provide the first extended position for the shelf. For providing a complete extension of the shelf addition forward pressure may be applied thereto whereby the shelf and slide rods move simultaneously until the stop 58 engage the supports 12.

It will be readily apparent that this foremost position of the shelf 60 provides ready access to each and every item which may be disposed on the shelf, even those items disposed at the rearmost portion thereof. Of course, the flanges 79 preclude accidental sliding of the goods from the shelves during the movement of the shelves. Thus, the device 10 organizes the space of compartment 80 in such a manner that not only can substantially the entire volume of the compartment be utilized for storage of items, but also each and every item stored therein will be accessible for both use and inventory purposes.

Figure 9:
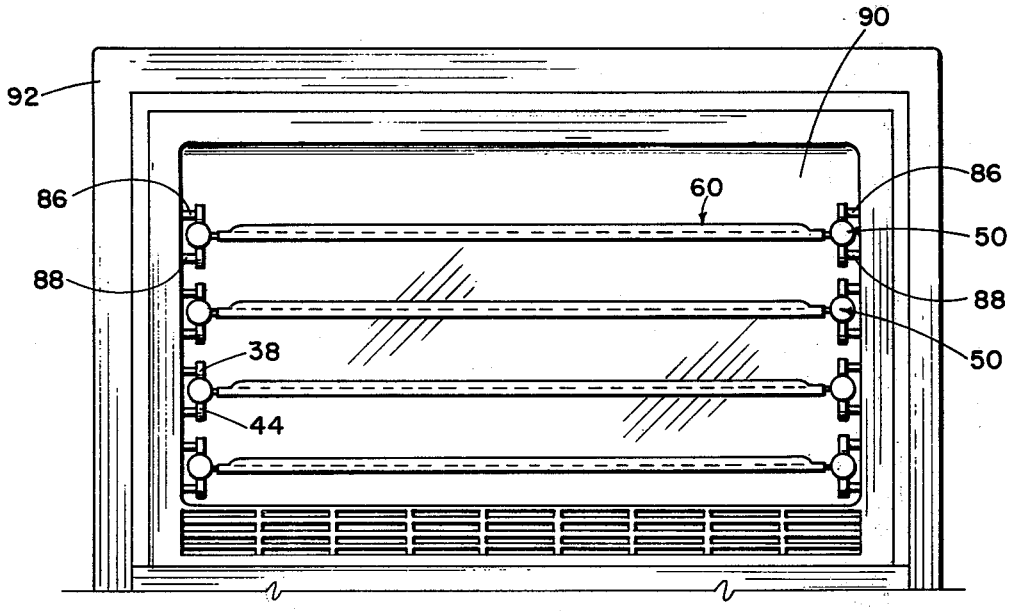
FIG. 9 is a front elevational view of a modified space saving and organizing device embodying the invention as installed in a freezer compartment.

Whereas the device 10 as illustrated in FIGS. 1 through 7 may be utilized in substantially any already existing freezer compartment or main refrigerator storage area, it is to be understood that the invention may also be utilized as a "built-in" feature during the construction of new freezers, refrigerators, and/or freezing compartments thereof. As particularly shown in FIG. 9, the rollers 38 and 44 may be journalled on suitable stud members 86 and 88, respectively, provided on the sidewalls of a freezer compartment 90 such as may be provided in a refrigerator 92. A slide rod assembly 50 may be disposed between each corresponding pair of rollers 38 and 44 for supporting a shelf 60 in the same manner as hereinbefore set forth. The operation of the slide rod assemblies with respect to the rollers 38 and 44 is the same as in the unit 10. The advantages of initially providing the freezer compartment 90 with the shelves 60 and slide rod assemblies 50 will be readily apparent.

Figure 10:
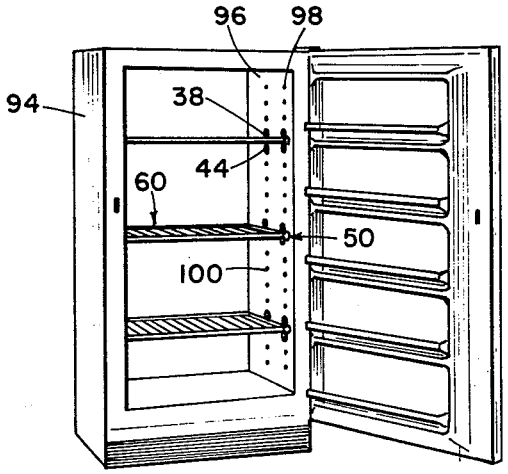
FIG. 10 is a perspective view of an upright freezer having the modified space saving and organizing device installed thereon.

As shown in FIG. 10, the invention may also be applied to a freezer unit 94 (or refrigerator). In this instance, the interior sidewalls 96 of the freezer 94 may be provided with a plurality of first vertically spaced bores 98 and a plurality of second vertically spaced bores 100 disposed rearwardly of the first bores 98. The rollers 38 and 44 may be suitably journalled in the bores 98 and 100 in such a manner as to receive the slide rod assemblies 50 therebetween for supporting shelves 60 as hereinbefore set forth. Only three of the shelves are shown in FIG. 10 for purposes of illustration, but it is to be understood that substantially any number of the shelves 60 may be disposed in the freezer 94 and with substantially any desired vertical spacing therebetween.

From the foregoing it will be apparent that the present invention provides a novel space saving and oganizing device for increasing the efficient use of a normally empty storage compartment. A plurality of shelves are slidably disposed within the compartment at substantially any vertical spacing therebetween, and slide rod assemblies support each of the shelves in such a manner that the contents of each shelf are readily available at all times. The novel apparatus converts a substantially small storage area, such as a freezing compartment in a home refrigerator, into a use corresponding to a relatively large storage area, thus providing economy for the user of such device.

The flexibility of the portable embodiment of the invention will permit transient people to purchase the device just once, assemble and install it in a suitable compartment, then easily disassemble it for removal from the compartment, and with little adjustment reassemble and install in the new refrigerator compartment found or purchased at their next location.

Whereas the present invention has been described in particular relation to the drawings attached hereto, it should be understood that other and further modifications, apart from those shown or suggested herein may be made within the spirit and scope of this invention.

What is claimed is:

1. Space saving and organizing means for a refrigerator compartment and comprising a plurality of roller means adjustably secured in said compartment, vertical adjustment means provided in said compartment providing selective vertical spacing of said roller means, slide rod assembly means carried by each of said roller means and reciprocally slidable in said compartment, shelf means supported by each of said slide rod assembly means, and connecting means cooperating between said shelf means and respective slide rod assembly means for facilitating movement of said shelf means between a normal retracted storage position within said compartment and an extended cantilevered position with respect to said compartment for access to substantially the entire upper surface of the shelf wherein said slide rod assembly means comprises an elongated sleeve member having the opposite ends thereof closed by stop means, and elongated slot means provided in the sidewall of said sleeve member and extending between the stop means for slidably receiving said cooperating means therethrough, and said connecting means comprises arm means adjustably secured to the side edges of said shelf means and extending outwardly therefrom, roller means journalled on said arm means and engagable with inner perphery of said elongated sleeve member for selective movement therealong to provide for said movement of the shelf means between the retracted and cantilevered positions.

2. Space saving and organizing means for a refrigerator compartment and comprising a plurality of roller means adjustably secured in said compartment, vertical adjustment means provided in said compartment providing selective vertical spacing of said roller means, slide rod assembly means carried by each of said roller means and reciprocally slidable in said compartment, shelf means supported by each of said slide rod assembly means, and connecting means cooperating between said shelf mean and respective slide rod assembly means for facilitating movement of said shelf means between a normal retracted storage position within said compartment and an extended cantilevered position with respect to said compartment for acess to substantially the entire upper surface of the shelf; wherein the shelf means includes length adjusting means for selectively varying the overall length thereof; and said length adjusting means comprises first frame means, second frame means reciprocally secured to said first frame means, spring means cooperating between said frame means for constantly urging said frame means in opposite directions, and locking means cooperating between said first and second frame means for locking the frame means in a preselected position therebetween to provide substantially any length for the shelf.

3. Space saving and organizing apparatus for removable disposition within a freezer compartment and comprising support rod means for removably supporting the apparatus in the compartment, a plurality of complementary pairs of roller means adjustably secured to said support rod means for selective vertical spacing between said complementary pairs of roller means, slide rod assembly means carried by each of said complementary pair of roller means and horizontally reciprocal within said compartment, substantially horizontally disposed shelf means supported by said slide rod assembly means in vertically spaced relationship, and connecting means adjustably secured to said shelf means and cooperating with said slide rod assembly means whereby said shelf means may be selectively moved between a contracted position wholly within said compartment and an extended cantilevered position extending beyond the confines of the compartment for facilitating independent access to substantially the entire upper surface of each shelf means.

4. Space saving and organizing apparatus as set forth in claim 3 wherein the shelf means comprises a plurality of substantially flat plate members each having the opposite ends thereof supported by the slide rod assembly means.

5. Space saving and organizing apparatus as set forth in claim 4 wherein each flat plate member is of an adjustable length for providing substantially universal usage for said apparatus.

* * * * *